US005457840A

United States Patent [19]

Derechin

[11] Patent Number: 5,457,840

[45] Date of Patent: Oct. 17, 1995

[54] FATIGUE RESISTANT SHEAR CONNECTOR

[76] Inventor: Joshua Derechin, 5 Carver St., Pawtucket, R.I. 02860

[21] Appl. No.: 248,257

[22] Filed: May 24, 1994

[51] Int. Cl.[6] ..... E01D 19/12

[52] U.S. Cl. ..... 14/73; 14/6

[58] Field of Search ..... 14/73, 73.1, 3–6

[56] References Cited

U.S. PATENT DOCUMENTS

| | | | |
|---|---|---|---|
| 3,842,552 | 10/1974 | Hudson | 14/73 X |
| 4,604,841 | 8/1986 | Barnoff et al. | 14/73 |
| 4,710,994 | 12/1987 | Kishida et al. | 14/73 |
| 4,831,675 | 5/1989 | Nedelcu | 14/73 |
| 5,025,522 | 6/1991 | Eskew et al. | 14/6 X |
| 5,033,147 | 7/1991 | Svensson | 14/6 X |

*Primary Examiner*—Michael Powell Buiz
*Attorney, Agent, or Firm*—Kevin Fortin

[57] ABSTRACT

A fatigue resistant shear connector for attaching a bridge deck to a top flange of a girder. The shear connector includes a shear resistor attached to the top flange. A portion of the shear resistor extends upward from the top flange into the bridge deck to cause composite cooperation between the bridge deck and the girder. A resilient spacer is juxtapositioned with top flange and at least one friction plate underlies the top flange. An adjustable fastener attaches between the friction plate and the shear resistor to draw the friction plate and the shear resistor together against the top flange to compress the resilient spacer and firmly attach the shear connector to the girder with a desired amount of force to resist fatigue forces without reducing the strength of the girder.

20 Claims, 4 Drawing Sheets

FATIGUE RESISTANT SHEAR CONNECTOR

FIELD OF THE INVENTION

This invention relates generally bridge deck supports, and more specifically to shear connectors which interconnect bridge decks to supporting girders.

BACKGROUND OF THE INVENTION

In typical bridges, girders extend between piers to support a bridge deck. Shear connectors secure the bridge deck to the girders and prevent the bridge deck from sliding during normal loading. Optimal bridge span design typically requires composite cooperation between the bridge decks and girders to maximize the load bearing capacity of the span. With composite design, structural integrity is enhanced, safety is increased, material requirements and cost are reduced. When the earth supporting the bridge moves however, such as during an earthquake, the shear connectors fail. Accordingly, the shear connectors may to permit movement of the bridge deck. This bridge deck movement reduces stress on supporting piers to prevent damage to the supporting piers and possible collapse.

Two types of shear connectors include pin-type shear connectors as shown in FIG. 4 and channel-type shear connectors as shown in FIG. 5. Pin-type shear connectors are vertically aligned metal studs which have a first end welded to the top flange of a girder and a second end which extends upward for attachment with a bridge deck. The channel-type shear connectors are horizontally aligned metal rods having a "C" shaped profile. The bottom surface of each connectors is welded horizontally across the top flange of a girder and the top of the shear connector extends upwardly from the top flange to attach with a bridge deck.

Two major problems are associated with the welded attachment of above described shear connectors. Firstly, each weld made on a steel girder, reduces girder strength in the area of the weld. Girder strength is crucial where the girder experiences a negative bending moment and the top flange of the girder is in tension. Accordingly girder size and strength design must be adapted to compensate for weakness due to the weld, or the weld could cause failure of the girder. In view of these problems, the use of welded shear connectors is generally avoided in the regions of the girder experiencing tension and negative bending moments. Because the use of shear connectors is limited, ideal composite cooperation is not achieved and overall bridge safety and load bearing capacity may be compromised.

A second problem is that the above described shear connecters have a tendency to fail due to fatigue stress. Fatigue stress considerations require closer spacing and a greater number of shear connectors than would otherwise be required. Bridge construction costs are increased.

In view of the above limitations, the present inventive concept was developed and provides an improved shear connector. The improved shear connector firmly connects a bridge deck to a girder to achieve a composite structure. Welds which reduce girder strength are not required. Fatigue stresses are reduced.

SUMMARY AND OBJECTS OF THE INVENTION

The present invention is directed to a fatigue resistant shear connector for attaching a bridge deck to a top flange of a girder. The shear connector includes a shear resistor attached to the top flange. A portion of the shear resistor extends upward from the top flange into the bridge deck to cause composite cooperation between the bridge deck and the girder. A resilient spacer juxtapositioned with the top flange increases frictional force between the shear connector and the top flange. At least one friction plate underlies the top flange. An adjustable fastener attaches between the friction plate and the shear resistor. The adjustable fastener draws the friction plate and the shear resistor together against the top flange to compress the resilient spacer. Compression of the resilient spacer increases friction to firmly attach the shear connector to the girder with a desired amount of force. The cooperation of the resilient spacer and adjustable fastener permits the shear connector to resist fatigue forces.

The shear resistor includes a first end and a second end which extend beyond the edges of the top flange. The friction plate includes a portion which extends beyond the edge of the top flange. Accordingly, the adjustable fastener attaches between each end of the shear resistor and the respective extended portion of the friction plate. Connection of the shear connector with the girder does not interfere with, or reduce, the strength of the girder. Accordingly, the shear connector is particularly useful where girder strength is important such as in negative bending moment regions and regions where the top flange is in tension.

Accordingly, it is an object of the present invention to provide an improved shear connector which is held by friction and is not welded to a girder.

Another object is to provide a shear connector which does not significantly reduce girder strength during attachment to the girder.

An object is to provide a channel type shear connector which is not significantly affected by fatigue stress.

Another object is to provide a shear connecter which may be used in the negative bending moment regions of a girder and regions where the top flange of a girder is in tension.

A further object is to profile a shear connector which enables composite cooperation between a bridge deck and a supporting girder.

Still another object of the invention is to provide a method of using a shear connector.

A more complete appreciation of the invention and many of the attendant advantages thereof will become apparent and better understood by reference to the description of the preferred embodiment when considered in conjunction with the accompanying drawings.

DESCRIPTION OF THE PREFERRED EMBODIMENT

Figure 1:
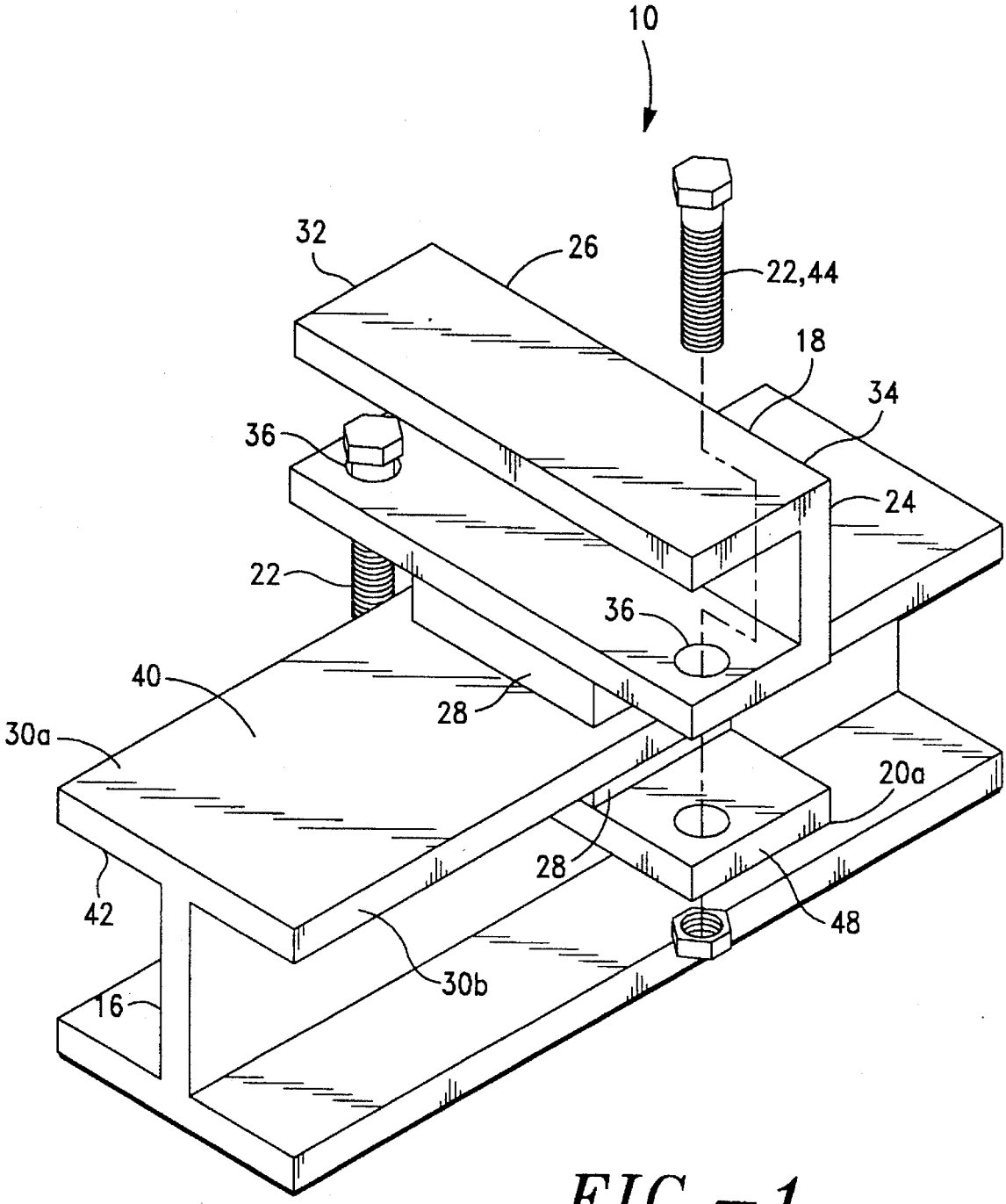
FIG. 1 is an isometric view of a shear connector attached to a girder.
Figure 2:
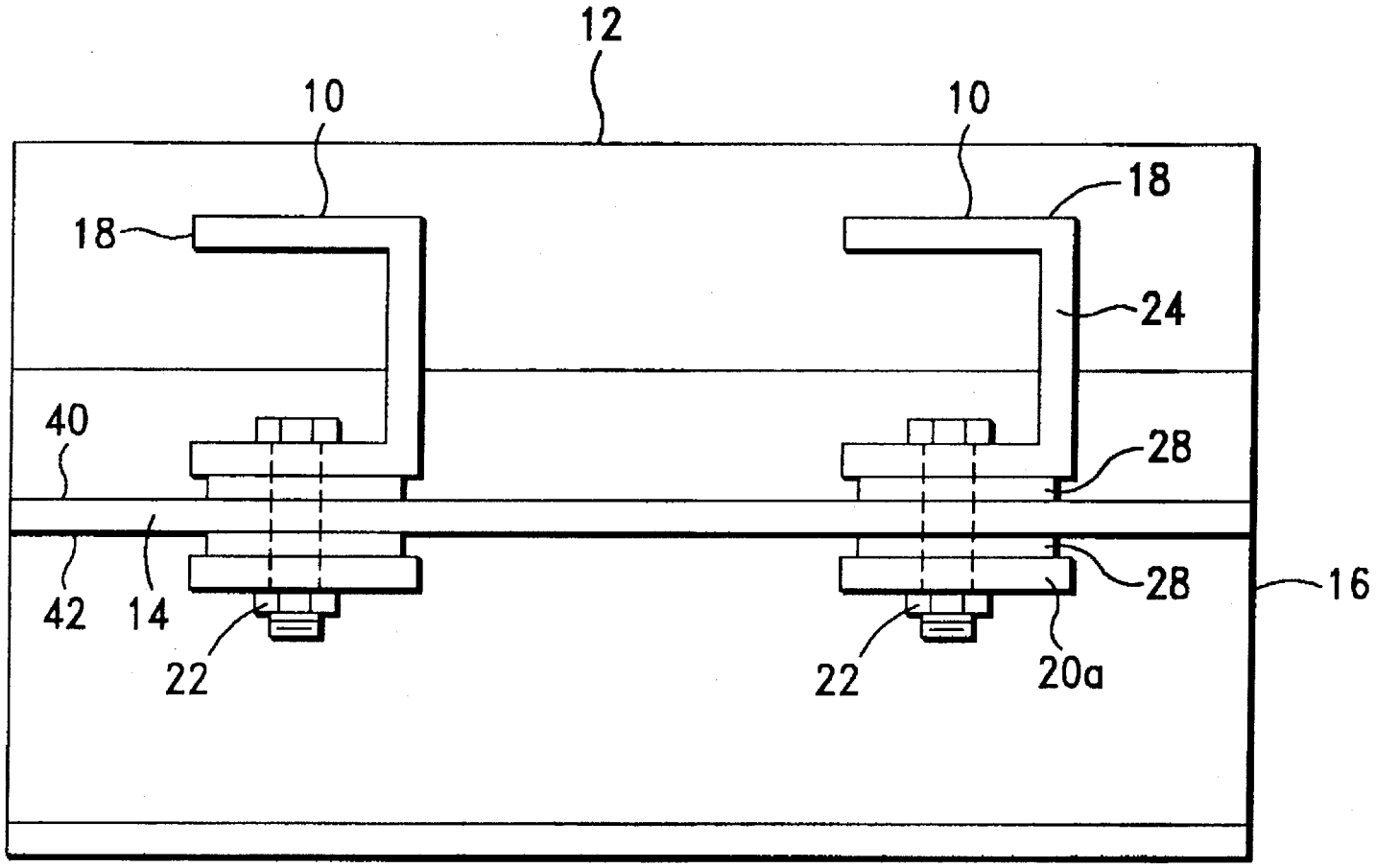
FIG. 2 is a side view of two shear connectors interconnecting a girder with a bridge deck.

Referring to FIG. 1 and FIG. 2 of the drawings, a shear connector 10 is shown and is adapted for attachment between a bridge deck 12 and the top flange 14 of a girder 16. Shear connector 10, as shown, includes a shear resistor 18, two friction plates 20*a* and 20*b* and an adjustable fastener 22. A resilient spacer 28 is positioned between shear connector 10 and girder 16. Adjustable fastener 22 draws the friction plates 20*a–b* and shear resistor 18 together against top flange 14 and resilient spacer 28. This cooperation of structure minimizes fatigue stresses imposed on shear connector 10 by bridge deck 12 and girder 16 without significantly reducing the strength of girder 16. Accordingly, shear connector 10 is particularly useful where girder strength must be maintained such as in regions of girders which experience negative moments and top flange tension.

Referring to FIG. 1, shear connector 10 is shown positioned on the upper-side 40 of top flange 14 on girder 16. Shear resistor 18 is a steel bar having a "C" shaped profile 24 and a length 26 which extends across top flange 14. More particularly, top flange 14 is formed with parallel edges 30*a* and 30*b* and shear resistor 18 is formed with a first end 32 and a second end 34 which overhang edges 30*a* and 30*b* respectively. A hole 36 is formed in each end 32 and 34 to facilitate connection with adjustable fastener 22. In the preferred embodiment, shear resistor 18 has a strength relatively less than the strength of adjustable fastener 22 and is fabricated from metal such as ASTM A36 to ASTM A50 grade steel. To resist corrosion, shear connector 10 is painted or galvanized.

Referring now to FIG. 2, shear connector 10 is shown having a portion of shear resistor 18 extending upward from upper-side 40 of top flange 14 into bridge deck 12. Shear connector 10 secures bridge deck 12 with girder 16 to facilitate composite cooperation between bridge deck 12 and girder 16. It can be appreciated that any of a number of shear connectors 10 may be used with a plurality of girders 16 and a bridge deck to facilitate composite cooperation and thereby maximize permitted loading, optimize safety and reduce construction costs.

When the earth supporting the bridge pier moves however, a shear force ($F_s$) will be imposed on shear resistor 18 by bridge deck 12. When $F_s$ reaches a pre-selected value, shear connector 10 will deform or slip and permit bridge deck 12 to move. As is well-known in the art of shear connectors, shear resistor 18 is appropriately positioned with respect to bridge deck 12 and includes an appropriate geometry to permit failure in response to a desired value of $F_s$. Ideally, stresses from the moving earth will be relieved by the movement of bridge deck 12, the bridge piers will not be destroyed and the bridge will not collapse.

Figure 3:
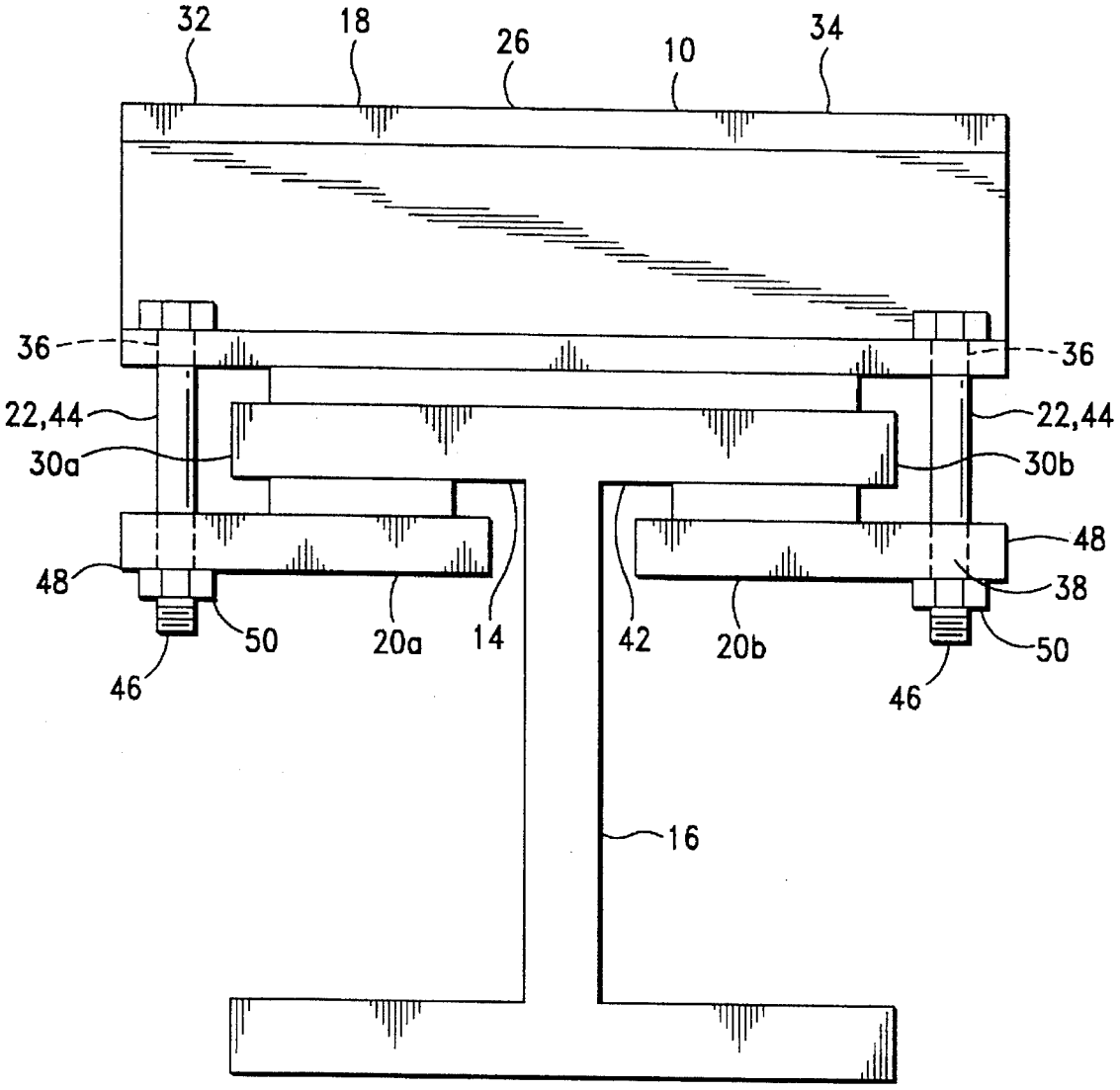
FIG. 3 is an front view of a shear connector attached to a girder.
Figure 4:
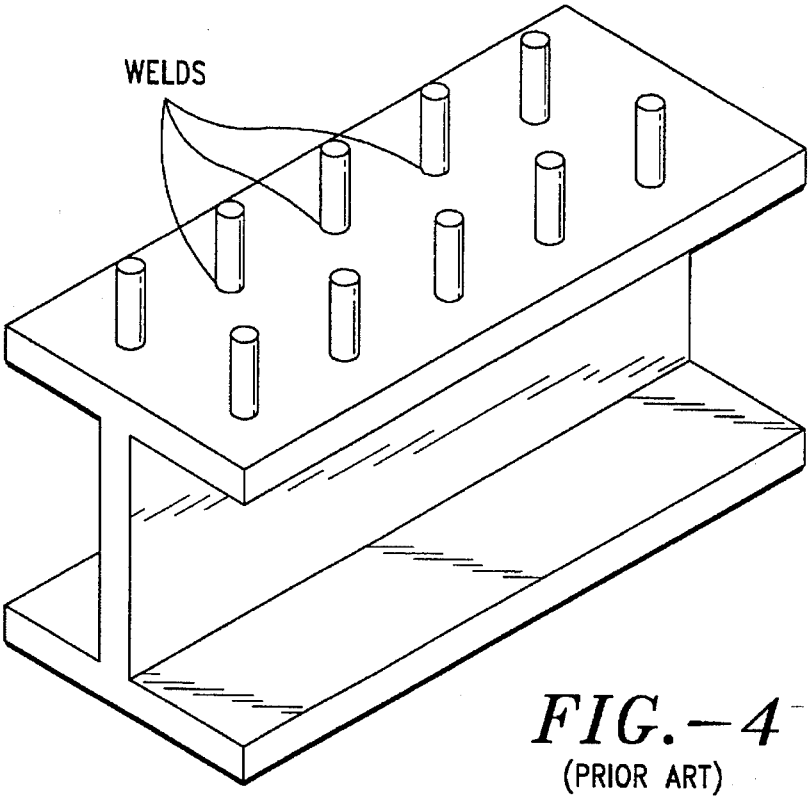
FIG.—4 (PRIOR ART)
FIG. 4 is an isometric view of pin-type shear connectors welded to the top flange of a girder.
Figure 5:
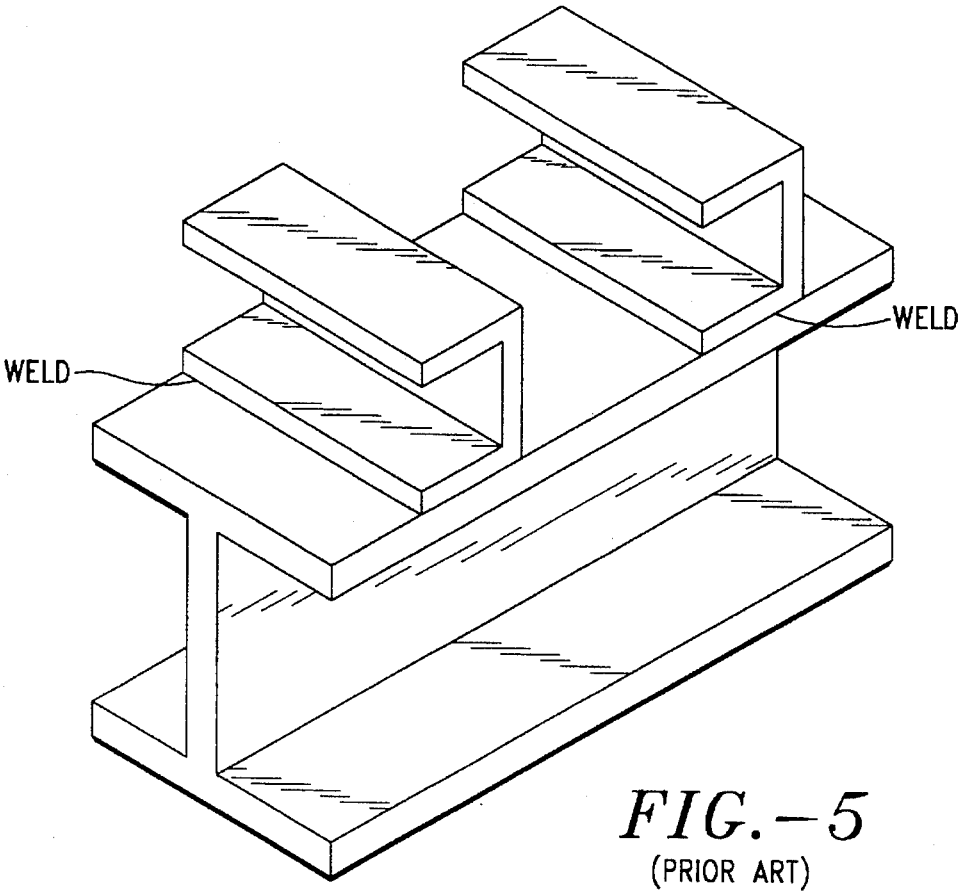
FIG.—5 (PRIOR ART)
FIG. 5 is an isometric view of channel-type shear connectors welded to the top flange of a girder.

Referring also to FIG. 3, friction plates 20*a* and 20*b* underlie top flange 14 on underside 42. Each friction plate 20*a–b* is attached with shear resistor 18 by at least one adjustable fastener 22. Proper adjustment of adjustable fastener 22 firmly holds shear connector 10 in place on girder 16 during normal bridge loading while permitting shear connector 10 to resist fatigue. As shown, each friction plate 20*a–b* includes an extended portion 48 which extends beyond top flange 14 at either edge 30*a* or edge 30*b* and includes a hole 38 for attachment to adjustable fastener 22. Accordingly, at least one adjustable fastener 22 attaches with each friction plate 20*a* and 20*b* at the extended portion 48, and with first end 32 and second end 34 of shear resistor 18 respectively. Adjustable fastener 22, as shown in the preferred embodiment, does not interfere with or contact girder 16. Each friction plate 20*a–b* is formed with an appropriate geometry such as uniform thickness to evenly distribute forces against top flange 14 so that attachment of friction plate 20 will not significantly weaken girder 16.

A resilient spacer 28 is juxtapositioned with top flange 14 to space shear resistor 18 from top flange 14. Resilient spacer 28 is positioned both between shear resistor 18 and the upper-side 40 of top flange 14 and between friction plate 20 and the underside 42 of top flange 14. Alternatively, resilient spacer 28 may be positioned at either of the above mentioned locations. Resilient spacer 28 is fabricated from any durable resilient material capable of resisting corrosion and withstanding high pressures (e.g. 50 ksi–100 ksi). In the preferred embodiment, resilient spacer is fabricated from a neoprene block. It can be appreciated however, by those skilled in the art that any appropriate material or geometry may be used.

Resilient spacer 28 has a surface characterized by a relatively greater coefficient of friction than steel used for shear resistor 18 to cooperate with adjustable fastener 22 to regulate friction between top flange 14 and shear connector 10 and to facilitate composite cooperation between bridge deck 12 and girder 16. An appropriate coating may be applied to, or included with resilient spacer 28 to reduce wear, increase life and achieve a desired coefficient of friction.

Adjustable fastener 22 attaches directly between friction plate 20 and shear resistor 18 and draws friction plate 20 and shear resistor 18 together against top flange 14 to secure shear connector 10 on girder 16. In the preferred embodiment as shown in FIGS. 1–3, adjustable fastener 22 is a high-strength steel bolt 44. Each bolt 44 is formed having helical threads 46 and includes a nut 50 so that when bolt 44 is rotated relative to nut 50, shear resistor 18 and friction plate are drawn together. Bolt 44 and nut 50 are fabricated from high strength material such as ASTM A325 steel and have a yield strength of, for example, 50 ksi–100 ksi. Bolt 44 is rotated by an operator at a desired torque and compresses resilient spacer 28 to attach bridge deck 12 to girder 16 and cause composite cooperation between bridge deck 12 and girder 16.

Resilient spacer 28 is deformable in response to rotation of bolt 44 at a desired torque to minimize fatigue stress imposed on shear connector 10 due to, for example, dynamic bridge loading. Deformation of resilient spacer 28 causes resilient spacer 18 to geometrically conform to the surface of top flange 14 to maximize the area of surface contact with top flange 14, this maximizes friction and eliminates the transmission of point forces from shear connector 10, through resilient spacer 18 to top flange 14. Proper compression of resilient spacer 28 also regulates fatigue stresses encountered by shear resistor 18 without weakening girder 16. Accordingly shear connector 10 may be attached in a negative moment region where top flange 14 is in tension.

Adjustable fastener and shear connector 10 are removable from girder 16 by counter-rotation of bolt 44 with respect to nut 50. Removal of adjustable fastener 22 from shear connector 10 permits, for example, repositioning of shear connector 10 to meet new specifications mandated by new bridge design guidelines, replacement of a damaged shear connector, and to ease replacement of bridge deck 12.

In Operation

In operation, shear connector 10 connects bridge deck 12 to girder 16 which extends between bridge support structures such as piers. To use shear connector 10, at least one resilient spacer 28 is juxtapositioned with the upper-side 40 and with the underside 42 of top flange 14. Shear resistor 18 is laid across top flange 14. First end 32 and second end 34 of shear resistor 18 extend beyond edges 30*a–b* of top flange respectively to provide connection points for adjustable fastener 22.

A pair of friction plates 20*a–b* are positioned at the underside 42 of top flange 14. Each friction plate 20 and shear resistor 18 are drawn together against top flange 14 by rotation of adjustable fastener 22. Each resilient spacer 28 is compressed between top flange 14 and either shear resistor 18 or a friction plate 20*a* or 20*b* by rotation of adjustable fastener at a desired torque. Thus, shear connector is attaches to girder 16. Bridge deck 12 is then laid on girder 16 and attached to girder 16 by shear connector 10. An operator may counter-rotate adjustable fastener 22 to re-adjust the desired torque and to remove said shear connector from the girder.

As disclosed, the invention provides a method and device for connecting a bridge deck to a girder. While the invention is described in terms of a preferred embodiment, it can be appreciated that those skilled in the art, that certain changes and modifications can be made without departing from the scope of the invention. The scope of the appended claims are, therefore, to be understood as including such likely changes and modifications.

I claim:

1. A fatigue resistant shear connector for connecting a bridge deck to an underlying girder formed with a top flange comprises:

a resilient spacer juxtapositioned with the top flange;

a means for resisting shear forces positioned on the top flange, said means for resisting shear forces extends upward from the top flange into the bridge deck to facilitate composite cooperation between the bridge deck and the girder;

at least one friction plate underlying the top flange; and an adjustable fastener attached between said friction plate and said means for resisting shear forces to draw each said friction plate and said means for resisting shear forces together against the top flange to compress said resilient spacer and thereby regulate friction between the top flange and said shear connector.

2. A shear connector as recited in claim 1 wherein said means for resisting shear forces is a steel bar having a "C" shaped profile.

3. A shear connector as recited in claim 2 wherein the top flange includes a first edge and a second edge, said steel bar includes a first end and a second end which overhang the first edge and the second edge respectively, and each said friction plate includes an extended portion to extends beyond the first edge and the second edge respectively to permit attachment of said adjustable fastener between each said extended portion and said first end and said second end respectively.

4. A shear connector as recited in claim 3 wherein said adjustable connector is a steel bolt having a strength within the range of 50–100 ksi, said bolt includes helical threads and a nut to rotate and draw said shear connector against the top flange with a desired amount of force to regulate frictional force between said shear connector and the top flange.

5. A shear connector as recited in claim 4 wherein said resilient spacer is positioned between said friction plate and said top flange.

6. A shear connector as recited in claim 4 wherein said resilient spacer is positioned between said means for resisting shear force and said top flange.

7. A shear connector as recited in claim 4 wherein said resilient spacer is fabricated from neoprene and is formed having a surface characterized by a relatively greater coefficient of friction than the coefficient of friction of said resisting shear forces means to regulate friction between the top flange said shear connector to facilitate composite cooperation between the bridge deck and the girder.

8. A shear connector as recited in claim 7 wherein said resilient spacer compresses to conform to the surface of the top flange in response to rotation of said bolt to regulate fatigue stresses encountered by said shear connector.

9. A shear connector as recited in claim 7 wherein said resilient spacer includes a coating having a desired coefficient of friction to increase friction between said shear connector and said top flange.

10. A fatigue resistant shear connector for attaching a bridge deck to a top flange of a girder comprises:

a shear resistor resting on the top flange, a portion of said shear resistor extends upward from the top flange into the bridge deck to cause composite cooperation between the bridge deck and the girder;

a pair of friction plates underlying the top flange;

an adjustable fastener attached with each said friction plate and said shear resistor to urge each said friction plate against the top flange to attach said shear resistor on the top flange with a desired amount of force; and a resilient spacer juxtapositioned with said top flange for increasing frictional force between said shear connector and the top flange and for resisting fatigue.

11. A shear connector as recited in claim 10 wherein said resilient spacer is fabricated from neoprene and is positioned between the top flange and said shear resistor.

12. A device as recited in claim 10 wherein said resilient spacer is fabricated from neoprene and is positioned between the top flange and said friction plate.

13. A device as recited in claim 10 wherein said shear resistor is a steel bar having a "C" shaped profile.

14. A shear connector as recited in claim 12 wherein the top flange includes a first edge in parallel with a second edge and said shear resistor is formed having a first end and a second end which overhang the first edge and the second edge respectively to permit direct attachment of said adjustable fastener.

15. A shear connector as recited in claim 14 wherein said first end is formed with a hole and a second end formed with a hole, said friction plate is formed with a hole, and said fastener is a high-strength steel bolt having helical threads which extends directly through said hole in each said friction plate to a corresponding said hole in said shear resistor.

16. A shear connector as recited in claim 15 wherein said resilient spacer deforms in a desired amount when said bolt is rotated to minimize shear connector fatigue and to regulate frictional force between said shear connector and the top flange.

17. A method of installing a shear connector on a top flange of a bridge girder comprising:

positioning a resilient spacer between said shear connector and said top flange to reduce fatigue and regulate friction between said shear connector and said top flange;

positioning a shear resistor on the top flange of a bridge girder, said shear resistor formed from a metal bar having a "C" shaped profile, said shear resistor extends across and overhangs the top flange;

positioning two friction plates under the top flange; and drawing each said friction plate and said shear resistor together against the top flange with an adjustable fastener attached between each said friction plate and said shear resistor to attach said shear connector to the girder.

18. A method as recited in claim 17 wherein said fastener is a high strength steel bolt and said step of drawing requires rotating said high strength steel bolt to a desired torque.

19. A method as recited in claim 18 further comprising:

counter-rotating said high strength steel bolt to re-adjust said desired torque and to remove said shear connector from the girder.

20. A method as recited in claim 17 wherein each said friction plate includes an extended portion which extends beyond said top flange to permit direct attachment of said fastener between said shear resistor and said extended portion.

* * * * *